US010799928B2

(12) United States Patent
Hirata et al.

(10) Patent No.: US 10,799,928 B2
(45) Date of Patent: Oct. 13, 2020

(54) METHOD AND APPARATUS FOR FORMING METAL SHEET

(71) Applicant: TOYOTA BOSHOKU KABUSHIKI KAISHA, Aichi-ken (JP)

(72) Inventors: Kazuyuki Hirata, Toyota (JP); Harutaka Oda, Toyota (JP)

(73) Assignee: TOYOTA BOSHOKU KABUSHIKI KAISHA, Aichi-Ken (JP)

( * ) Notice: Subject to any disclaimer, the term of this patent is extended or adjusted under 35 U.S.C. 154(b) by 270 days.

(21) Appl. No.: 15/820,660

(22) Filed: Nov. 22, 2017

(65) Prior Publication Data

US 2018/0154417 A1 Jun. 7, 2018

(30) Foreign Application Priority Data

Dec. 6, 2016 (JP) ..... 2016-236845

(51) Int. Cl.
*B21D 13/02* (2006.01)

(52) U.S. Cl.
CPC ..... *B21D 13/02* (2013.01)

(58) Field of Classification Search
CPC ..... B21D 13/02; B21D 22/02; B21D 22/06; B21D 22/20; B21D 13/06; B21D 13/08; B21D 13/10; B21D 13/00; B21D 22/00
USPC ..... 72/348, 385, 379.6
See application file for complete search history.

(56) References Cited

U.S. PATENT DOCUMENTS 1,704,326 A * 3/1929 Junkers ..... B21D 13/02 428/603
2,186,288 A * 1/1940 Gallagher ..... B21D 13/02 72/385
2,741,834 A * 4/1956 Reed ..... B21D 13/02 72/374
2015/0290692 A1* 10/2015 Hirata ..... B21K 23/00 72/379.6
2016/0129491 A1* 5/2016 Taguchi ..... B21D 13/02 72/296

FOREIGN PATENT DOCUMENTS

JP 2007-048616 2/2007
JP 2014-213343 11/2014
JP 2014-231075 12/2014

OTHER PUBLICATIONS

Official Action in patent family member JP2016-236845 dated Jul. 14, 2020, along with English Translation.

* cited by examiner

*Primary Examiner* — Teresa M Ekiert
*Assistant Examiner* — Jared O Brown
(74) *Attorney, Agent, or Firm* — Greenblum & Bernstein, P.L.C.

(57) ABSTRACT

A method for forming a metal sheet includes forming a metal sheet to have curved portions that are alternately continuous in a corrugated pattern and angled sidewall portions between top parts of adjoining curved portions by use of a pair of forming dies that are moved close to or away from each other. The forming includes bending the metal sheet by pressing a position corresponding to a boundary part between the top part and the sidewall portion of the metal sheet by a convex curved surface of the forming die by moving the pair of forming dies close to each other and thereafter forming the sidewall portions by compression.

11 Claims, 6 Drawing Sheets

METHOD AND APPARATUS FOR FORMING METAL SHEET

BACKGROUND OF THE INVENTION

The present disclosure relates to a method and an apparatus for forming a metal sheet.

One known fuel cell separator is constituted by a metal sheet having a plurality of curved portions that are alternately continuous in a corrugated pattern for allowing hydrogen or oxygen to flow. A method and an apparatus for forming such a fuel cell separator are disclosed in, for example, Japanese Laid-Open Patent Publication No. 2007-48616 and Japanese Laid-Open Patent Publication No. 2014-213343.

Japanese Laid-Open Patent Publication No. 2007-48616 discloses a method that includes a pre-processing step of forming a wave-shaped separator sheet having a continuous circular-arc curved surface by applying press working to a separator material and a post-processing step of applying coining pressure to flatten a top part of the circular-arc curved surface. In the press working of the pre-processing step, when a convex side of a forming die presses the metal sheet, stretching force continuously acts from the beginning to the end of the press working without allowing a compressing force to act on the metal sheet because a concave side of the forming die is spaced from the metal sheet.

Japanese Laid-Open Patent Publication No. 2014-213343 discloses a method for forming a metal sheet through three steps. In a first step, the metal sheet is formed by stretch forming so as to have a wave-shaped curved portion whose top part is thinner than other parts. In a second step, a sidewall portion is formed by compressing the curved portion. In a third step, the top part of the curved portion is expanded.

SUMMARY OF THE INVENTION

In the methods disclosed in Japanese Laid-Open Patent Publication No. 2007-48616 and Japanese Laid-Open Patent Publication No. 2014-213343, another step of forming or the like is required to be performed subsequent to the step of stretching the metal sheet, and therefore a plurality of steps are undergone. As a result, installation of the forming apparatus becomes large-scale and productivity is lowered. Additionally, a plurality of processing steps, such as a stretching step and a compressing step, are applied to the same metal sheet, and therefore the metal sheet is greatly damaged. Accordingly, there has been a fear that the strength of the metal sheet that has been processed will be lowered, and its product life will be shortened. Additionally, in the step of stretching the metal sheet, the metal sheet is continuously stretched from the beginning to the end of the step. This could result in a shortage of the metallic material at the stretched part, which could cause a necking.

An object of the present invention is to provide a method and an apparatus for forming a metal sheet that are capable of reducing the number of processing steps performed on the metal sheet.

According to one aspect of the present invention, a method for forming a metal sheet is provided. The method comprises forming a metal sheet to have curved portions that are alternately continuous in a corrugated pattern and angled sidewall portions between top parts of adjoining curved portions by use of a pair of forming dies that are moved close to or away from each other. The forming comprises bending the metal sheet by pressing a position corresponding to a boundary part between the top part and the sidewall portion of the metal sheet by a convex curved surface of the forming die by moving the pair of forming dies close to each other and thereafter forming the sidewall portions by compression.

The forming may further comprise forming a part that has a smaller curvature radius and a part that has a larger curvature radius at the boundary part. In this case, the part having the smaller curvature radius is formed closer to the top part, and the part having the larger curvature radius is formed closer to the sidewall portion.

Parts of the metal sheet positioned on both sides of the convex curved surface are not necessarily required to be pressed by the forming die when the boundary part is bent.

According to another aspect of the present invention, an apparatus for forming a metal sheet is provided that includes a pair of forming dies that are disposed so as to face each other and so as to be movable close to or away from each other. Each forming die has a forming surface that includes recessed portions and projecting portions that are alternately continuous with each other and inclined portions between adjacent ones of the recessed portions and the projecting portions. Each of the projecting portions has two convex portions, each of which has a convex curved surface and is disposed closer to the inclined portion on each side of the projecting portion. The two convex portions protrude toward the recessed portion of an opposite forming die. A boundary part between each convex portion and the inclined portion adjoining the convex portion has at least one curved surface.

Other aspects and advantages of the present invention will become apparent from the following description, taken in conjunction with the accompanying drawings, illustrating by way of example the principles of the present invention.

DETAILED DESCRIPTION OF THE PREFERRED EMBODIMENTS

An embodiment of the present invention will be hereinafter described with reference to the drawings.

First, a configuration of a metal sheet 21 will be described.

Figure 1:
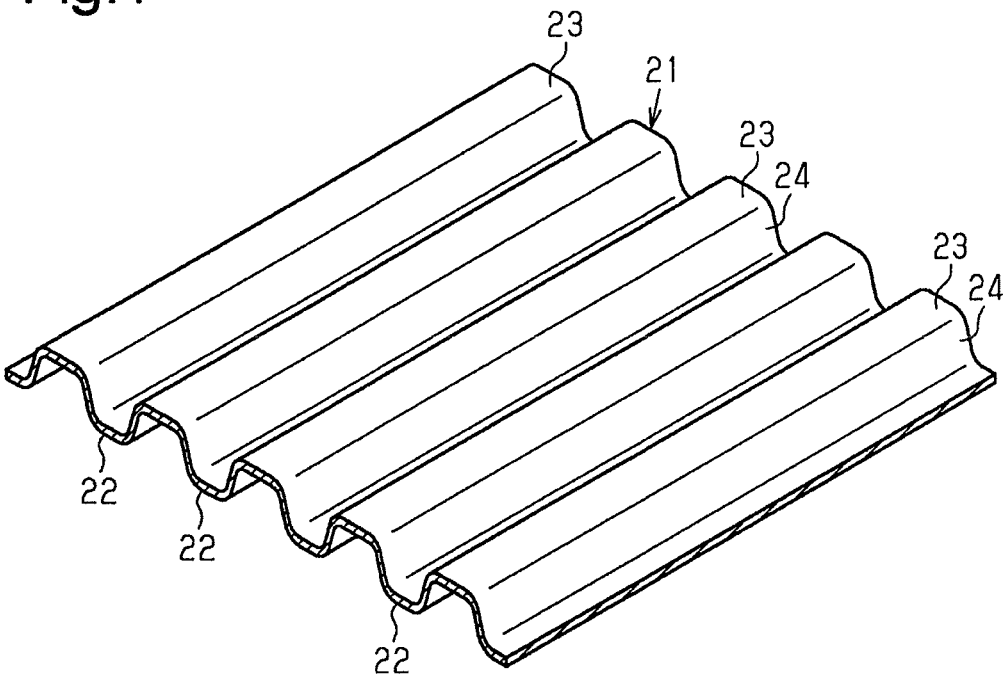
FIG. 1 is a perspective view of a metal sheet.
Figure 2:
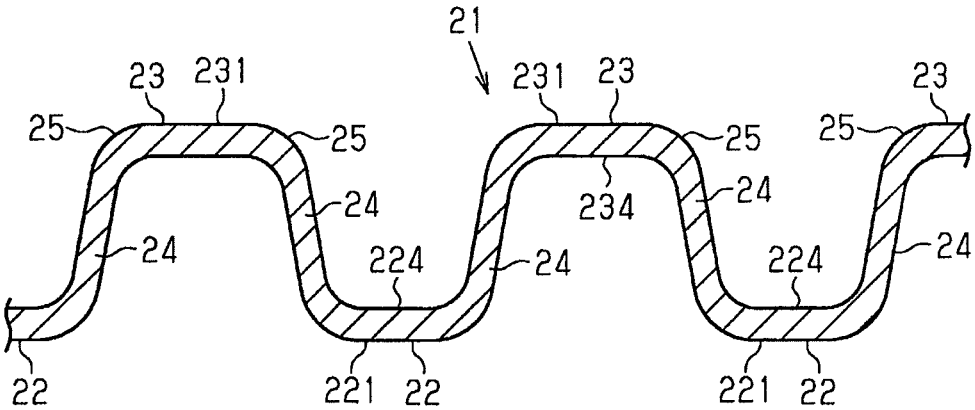
FIG. 2 is a cross-sectional view of the metal sheet.

As shown in FIG. 1 and FIG. 2, a metal sheet 21 that is to be used as a fuel cell separator has a plurality of curved portions 22, 23 alternately formed to have a corrugated shape. The width of the curved portions 22 are smaller than that of the other curved portions 23. The metal sheet 21 is made of a material having a good corrosion resistance, such as titanium, titanium alloy, or stainless steel.

Figure 9:
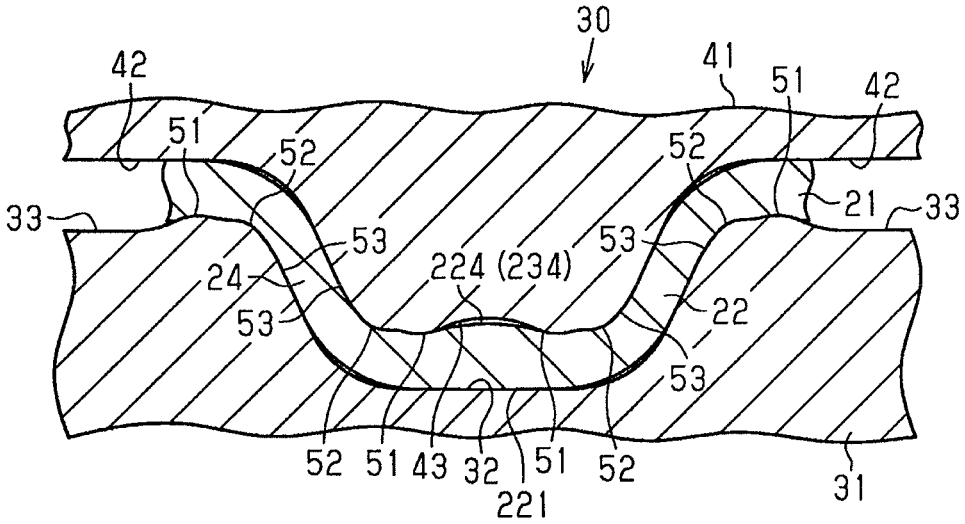
FIG. 9 is a cross-sectional view of the forming apparatus and the metal sheet when forming is ended.

As shown in FIG. 2, the curved portions 22, 23 include top parts 221, 231 and angled sidewall parts 24 between the top parts 221, 231. The curved portions 22, 23 each have a substantially trapezoidal profile. The sidewall part 24 makes an obtuse angle with respect to the top parts 221, 231. Outer surfaces of the top parts 221, 231 are flat. As shown in FIG. 9, central parts of bottom surfaces 224, 234 opposite the outer surfaces of the top parts 221, 231 are convex. Boundary parts 25 between the top parts 221, 231 and the sidewall parts 24 are curved. Words that indicate directions such as "upper" and "lower" used in the present embodiment are determined for convenience in description, and do not specify the direction of the metal sheet 21 when it is used. For example, the metal sheet 21 may be used in a state in which its top and bottom are reversed or in which it is vertically placed. In the present embodiment, the thickness of each top part 221, 231 of the curved portions 22, 23 is about 0.20 to 0.05 mm, such as 0.10 mm in its central part in a width direction. The thickness of the sidewall part 24 is about 0.15 to 0.03 mm, such as 0.07 mm.

The metal sheet 21 is formed by use of a forming apparatus 30.

Figure 3:
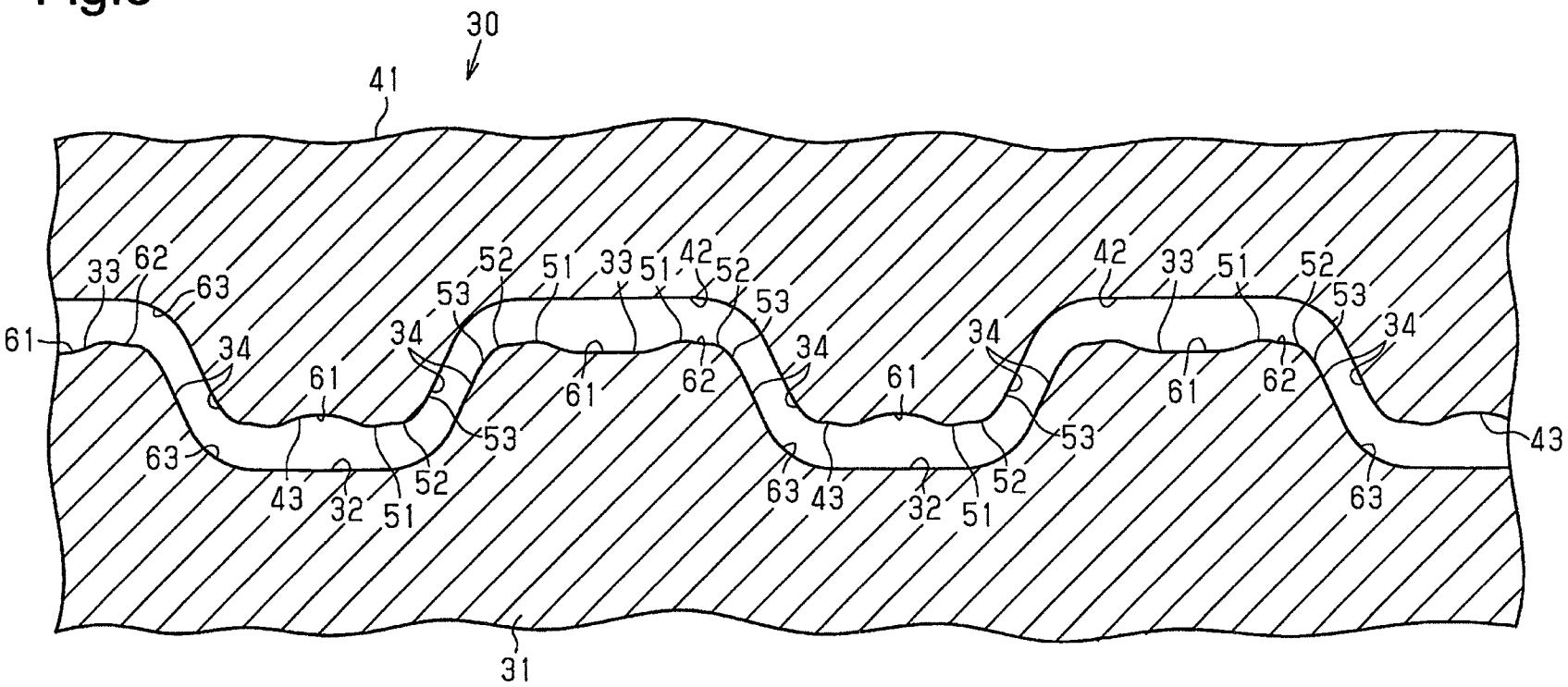
FIG. 3 is a cross-sectional view showing a forming surface of a die and a forming surface of a punch.
Figure 4:
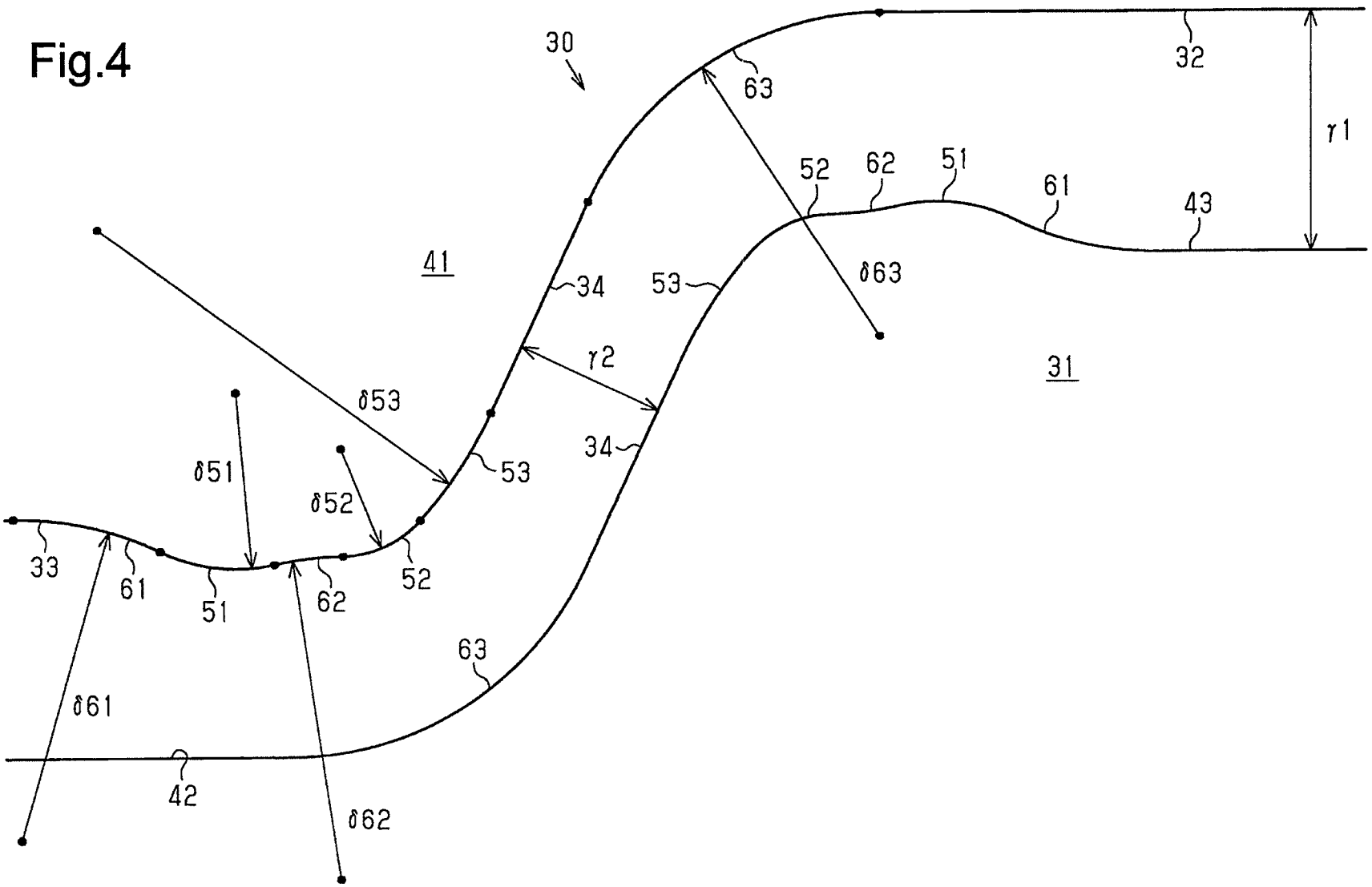
FIG. 4 is a cross-sectional view showing a shape of the forming surface of the die and a shape of the forming surface of the punch.

As shown in FIG. 3 and FIG. 4, the forming apparatus 30 includes a forming die that consists of a die 31 and a punch 41. The punch 41 is disposed so that it can move downwardly toward and upwardly away from the die 31 placed below the punch 41. Herein, the "die" refers to a stationary side die and the "punch" refers to a movable side die. However, the die 31 may be disposed on the upper side and the punch 41 may be disposed under the die 31, or the die 31 and the punch 41 may be moved away from or close to each other by moving both the die 31 and the punch 41. An upper surface of the die 31, which serves as a forming surface, includes recessed portions 32 and projecting portions 33, each of which has a trapezoidal shape. The recessed portions 32 and the projecting portions 33 are alternately disposed with equal intervals. A lower surface of the punch 41, which serves as a forming surface, includes projecting portions 43 and recessed portions 42 that respectively correspond to the recessed portions 32 and the projecting portions 33 of the die 31 in a concavo-convex relationship. The projecting portions 43 and the recessed portions 42 are alternately disposed with equal intervals. The projecting portions 33 of the die 31 and the recessed portions 42 of the punch 41 are larger in width than the recessed portions 32 of the die 31 and the projecting portions 43 of the punch 41.

Inclined portions 34 are formed on both sides of a top part of the projecting portion 33 of the die 31 and on both sides of a top part of the projecting portion 43 of the punch 41, respectively. A first concave portion 61 is formed at the center of each top part of the projecting portions 33, 43. The first concave portion 61 includes a concave curved surface having a certain curvature radius δ61. A first convex portion 51 that is continuous with the first concave portion 61 and a second concave portion 62 that is continuous with the first convex portion 51 are formed in this order from the center of the top part to the inclined portion 34 on each side of the top part. The first convex portion 51 includes a convex curved surface having a certain curvature radius δ51. The second concave portion 62 includes a concave curved surface having a certain curvature radius δ62. The curvature radius δ61 of the first concave portion 61 is larger than the curvature radius δ51 of the first convex portion 51. The curvature radius δ62 of the second concave portion 62 is equal to the curvature radius δ61 of the first concave portion 61.

A second convex portion 52 having a convex curved surface and a third convex portion 53 having a convex curved surface are formed at the boundary part between each top part of the projecting portions 33, 43 and the inclined portion 34. The third convex portion is located between the second convex portion 52 and the inclined portion 34. The curvature radius δ52 of the second convex portion 52 is smaller than the curvature radius δ51 of the first convex portion 51. The curvature radius δ53 of the third convex portion 53 is larger than the curvature radius δ51 of the first convex portion 51 and the curvature radius δ52 of the second convex portion 52.

A third concave portion 63 having a concave curved surface is formed at a boundary part between each bottom part of the recessed portions 32, 42 and the inclined portion 34 of the die 31 and the punch 41. The curvature radius δ63 of the third concave portion 63 is equal to the curvature radius δ61 of the first concave portion 61 and is equal to the curvature radius δ62 of the second concave portion 62.

The curvature radii δ51 to δ53 of the first to third convex portions 51 to 53 and the curvature radii δ61 to δ63 of the first to third concave portions 61 to 63 stand in the following relationship.

$$\delta 52<\delta 51<\delta 61=\delta 62=\delta 63<\delta 53$$

In the present embodiment, the curvature radii δ61, δ62, and δ63 are within the range of 0.10 to 0.20 mm, and are each, for example, 0.15 mm. The curvature radius δ52 is within the range of 0.01 to 0.10 mm, such as 0.05 mm. The curvature radius δ51 is within the range of 0.03 to 0.13 mm, such as 0.08 mm. The curvature radius δ53 is within the range of 0.15 to 0.25 mm, such as 0.20 mm.

Both ends of each of the convex portions 51 to 53 and each of the concave portions 61 to 63 are smoothly continuous with each other without forming a corner with other parts. The dots shown in FIG. 4 represents a continuous point of both the ends described above.

The bottom parts of the recessed portions 32, 42 are formed flatly. When the punch 41 reaches a bottom dead center, a maximum distance γ1 between each bottom part of the recessed portions 32, 42 and each top part of the corresponding projecting portions 33, 43 is larger than a distance γ2 between the inclined portions 34 facing each other. In detail, in the present embodiment, the distance γ1 is about 0.20 to 0.05 mm, such as 0.10 mm. The distance γ2 is about 0.15 to 0.03 mm, such as 0.07 mm.

Next, a description will be given of a method for forming a metal sheet by using the above-described forming apparatus.

First, a metal sheet 21 the entirety of which is flat and uniform in thickness is set on the die 31 at a home position at which the punch 41 of the forming apparatus 30 is placed away from the die 31. The thickness of the starting metal sheet 21 is about 0.20 to 0.05 mm, such as 0.10 mm.

Figure 5:
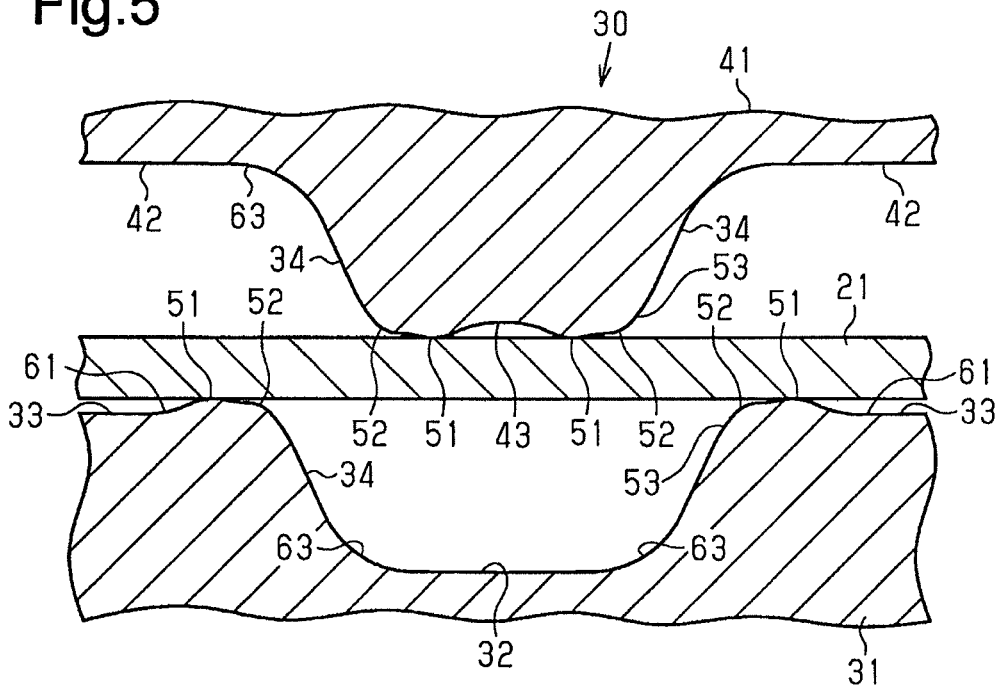
FIG. 5 is a cross-sectional view of a forming apparatus and a metal sheet when forming is started.

Thereafter, as shown in FIG. 5, the punch 41 is moved toward the die 31. Here, the metal sheet 21 starts to be formed between the recessed portions 32, 42 and the projecting portions 33, 43 of the die 31 and the punch 41 as shown in FIG. 6 to FIG. 9.

Figure 6:
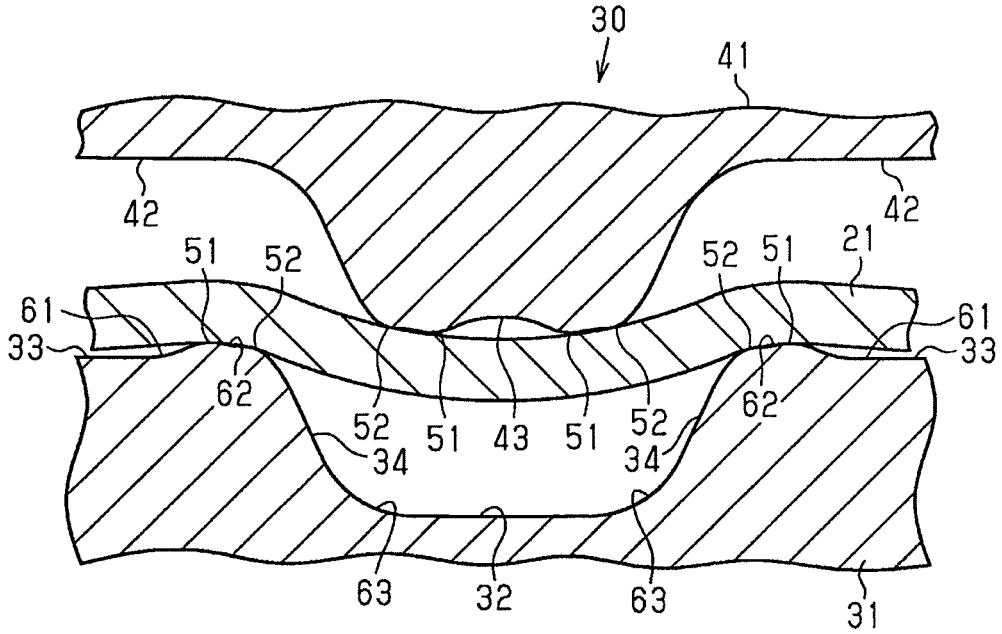
FIG. 6 is a cross-sectional view of the forming apparatus and the metal sheet in a forming step subsequent to that of FIG. 5.

FIG. 5 and FIG. 6 show initial stages of forming. First, the first convex portions 51 of the die 31 and the punch 41 are brought into contact with and press the metal sheet 21. These contact parts correspond to the sides of the bottom surfaces 224, 234 of the curved portions 22, 23 of the metal sheet 21 shown in FIG. 2. When the contact part of the metal sheet 21 starts to be bent toward the insides of the recessed portions 32, 42 of the die 31 and the punch 41, the metallic material of the contact part and the metallic material of a neighboring part around the contact part are moved to each side of the contact part, so that the contact part is thinned.

Figure 7:
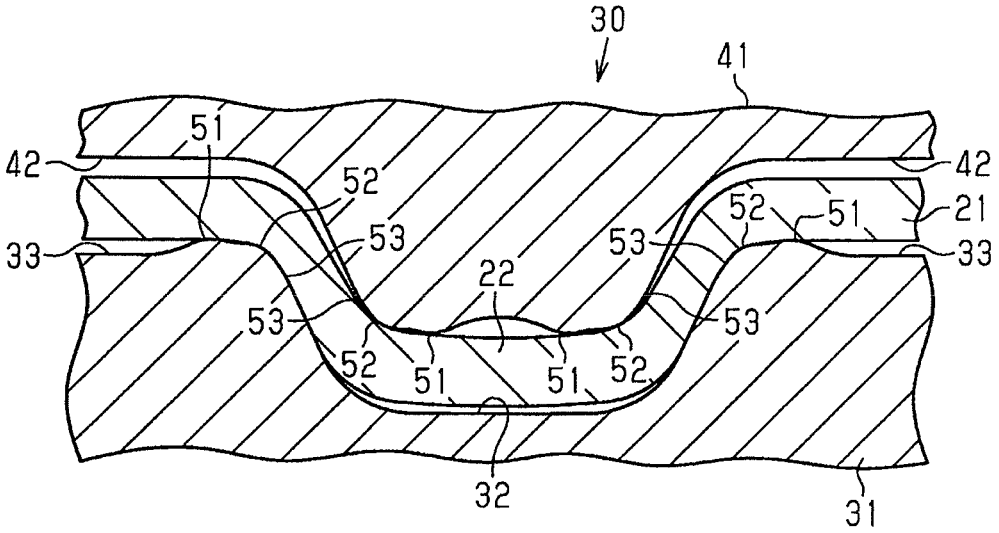
FIG. 7 is a cross-sectional view of the forming apparatus and the metal sheet in a forming step subsequent to that of FIG. 6.

Thereafter, the metal sheet 21 is continuously bent so that the boundary part 25 between each top part of the curved portions 22, 23 and the sidewall part 24 is formed. As shown in FIG. 6 and FIG. 7, the first concave portion 61 and the second concave portion 62 are formed on both sides of the first convex portion 51. Therefore, the metal sheet 21 is slightly spaced from the projecting portions 33, 43 at the concave portions 61, 62. Therefore, the metallic material of the contact part being in contact with the first convex portion 51 and the metallic material of the neighboring part are able to smoothly move toward the central parts of the projecting portions 33, 43 and the inclined portions 34 without substantial interference from the projecting portions 33, 43.

Figure 8:
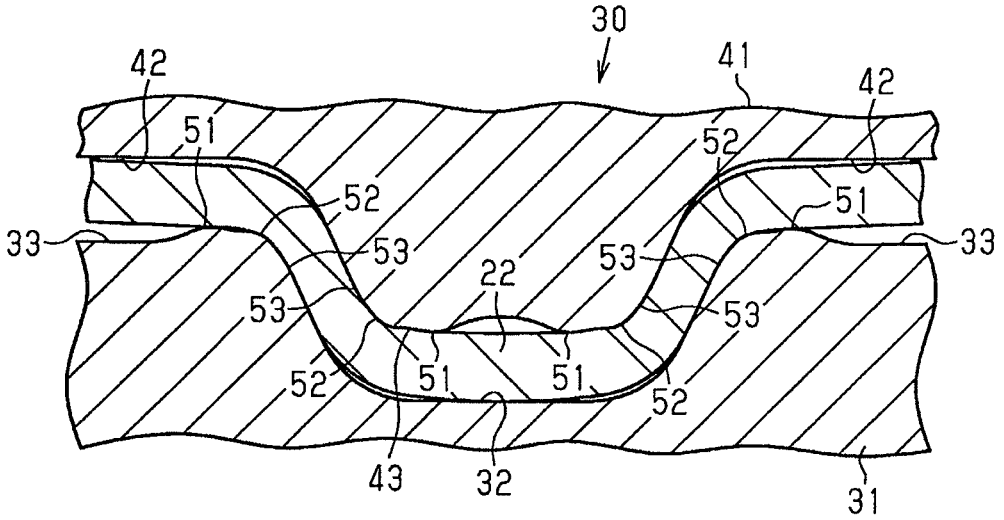
FIG. 8 is a cross-sectional view of the forming apparatus and the metal sheet in a forming step subsequent to that of FIG. 7.

As shown in FIG. 7 and FIG. 8, the metallic material that has been moved from the first convex portion 51 toward the inclined portion 34 is pressed by the second convex portion 52, and is thinned and further bent. Therefore, the metallic material of the metal sheet 21 is further moved toward the inclined portion 34. The metallic material that has been moved toward the inclined portion 34 is pressed, bent, and further thinned by the third convex portion 53 having the largest curvature radius δ53. Therefore, the metallic material is further moved toward the inclined portion 34.

As shown in FIG. 9, when the punch 41 has reached the bottom dead center, the top parts of the curved portions 22, 23 are received by the flat bottom surfaces of the recessed portions 32, 42 and are formed flatly. Here, the distance γ1 between the center in the width direction (lateral direction of FIG. 3 to FIG. 9) of each top part of the projecting portions 33, 43 and each bottom surface of the recessed portions 32, 42 facing thereto is equal to the thickness of the metal sheet 21. Therefore, in this part of the distance γ1, a compressing force hardly acts on the metal sheet 21. On the other hand, the distance γ2 between the inclined portions 34 is smaller than the thickness of the metal sheet 21. Therefore, the sidewall part 24 of the metal sheet 21 is compressed by the inclined portions 34 to have a thickness equal to the distance γ2. In this way, the metal sheet 21 in which each outer surface of the top parts 221, 231 of the curved portions 22, 23 is flat and that is usable as a separator is formed as shown in FIG. 1.

In the present embodiment, the following effects are obtained.

(1) The punch 41 is moved toward the die 31, and, as a result, the first convex portion 51, the second convex portion 52, and the third convex portion 53 of the projecting portions 33, 43 successively come into contact with the metal sheet 21, and successively press the metal sheet 21. Therefore, bending forces from the first convex portion 51, the second convex portion 52, and the third convex portion 53 act on the metal sheet 21 in this order. Further, the metal sheet 21 is pressed at positions of the first to third convex portions 51 to 53, and the metallic material of the metal sheet 21 is moved to a space between the inclined portions 34, and is compressed between the inclined portions 34. Therefore, even if stretching force acts on the metal sheet 21 between the inclined portions 34 at the beginning of forming, the metallic material is supplied to the side of the inclined portion 34 so as to make up for it, and therefore the necking of the metal sheet 21 does not occur at the position of the inclined portion 34. Additionally, a part of the metallic material is pressed and returned toward the first to third convex portions 51 to 53 because of compression between the inclined portions 34, and therefore necking is prevented from occurring in parts corresponding to the first to third convex portions 51 to 53.

As thus described, it is possible to form the metal sheet 21 having the curved portions 22, 23 by performing a single forming operation with use of the forming apparatus 30. Necking does not occur in the metal sheet 21 even if the metal sheet 21 is subjected to deep drawing through the single forming operation. Therefore, it is possible to shorten the processing time required for forming, and hence is possible to improve the processing efficiency. Additionally, there is no need to prepare dies and punches for a plurality of steps, and a large-scale installation is not needed. Additionally, since it is possible to form the metal sheet 21 by a single processing operation, physical damage inflicted on the metal sheet 21 is significantly reduced. Therefore, it is possible to provide a product of the metal sheet, such as a separator, that has high strength and excellent durability.

(2) The metal sheet 21 is pressed at a plurality of places at successive time intervals by the first convex portion 51, the second convex portion 52, and the third convex portion 53, and therefore it is possible to smoothly and naturally move the material of the metal sheet 21 toward the inclined portion 34 over some time. Therefore, it is possible to prevent necking from occurring in the sidewall part 24 of the metal sheet 21 even if the metal sheet 21 is stretched in a part of the inclined portion 34 at the beginning of forming.

(3) The curvature radius δ51 of the first convex portion 51 that is first brought into contact with and bends the metal sheet 21 is set to be larger than the curvature radius δ52 of the second convex portion 52, and the curvature radius δ53 of the third convex portion 53 that is continuous with the inclined portion 34 is set to be largest. Accordingly, when the metal sheet 21 is bent by the first convex portion 51, the second convex portion 52, and the third convex portion 53, stress concentrations within the metal sheet 21 are less likely to occur. This makes it possible to apply drawing to the metal sheet 21 without allowing necking to occur in the metal sheet 21.

(4) The first and second concave portions 61, 62 are formed on both sides of the first convex portion 51 that is first brought into contact with the metal sheet 21, and therefore the metallic material is smoothly moved without substantial interference from the top parts of the projecting portions 33, 43. As a result, the metal sheet 21 is smoothly formed, and physical damage of the metal sheet 21 or necking that is caused by a material shortage is restrained. Additionally, a load inflicted on the die 31 and the punch 41 is reduced, hence making it possible to improve the durability of the die 31 and the punch 41.

(5) As described above, the metallic material is smoothly and naturally moved toward the inclined portions 34 and compressed between the inclined portions 34. The metallic material is also moved toward the first concave portion 61 while substantially no compressing force acts on the top parts of the curved portions 22, 23 of the metal sheet 21. Therefore, stress that acts on the metallic material escapes toward the first concave portion 61, and therefore it is possible to reduce residual stress in the metal sheet 21. As a result, spring back hardly occurs in the metal sheet 21 after forming, and it is possible to obtain a product of the metal sheet 21 with a high accuracy.

(6) When the punch 41 reaches the bottom dead center, the metal sheet 21 is adequately compressed in a relatively wide region consisting mainly of the third convex portion 53 and the inclined portion 34. Therefore, there is no need to press the metallic material with a high pressure between the top parts of the projecting portions 33, 43 and the bottom parts of the recessed portions 32, 42 of the die 31 and the punch 41. This reduces a load inflicted on the die 31 and the punch 41, thus making it possible to improve the durability of the die 31 and the punch 41.

(7) Since the bottom surfaces of the recessed portions 32, 42 are flat, the distance between the first convex portions 51 on both sides of each projecting portion 33, 43 can be set as desired and each width of the curved portions 22, 23 can be set to a desired extent. Therefore, the metal sheet 21 is easily processed into a product such as a separator according to various performance requirements. Additionally, since the bottom surfaces of the recessed portions 32, 42 are flat, the outer surfaces of the top parts 221, 231 of the curved portions 22, 23 of the metal sheet 21 are formed flatly. Therefore, contact between the top parts 221, 231 and a counterpart such as a separator or a diffusion layer is enhanced, resulting in an improved electroconductivity.

The present invention is not limited to the aforementioned embodiment, and may be modified as follows.

The third convex portion 53 may be excluded, and only the first and second convex portions 51, 52 may be provided at the projecting portions 33, 43. In this case, it is preferable to make the curvature radius of the first convex portion 51 and the curvature radius of the second convex portion 52 larger than that in the aforementioned embodiment.

The first concave portion 61 and the second concave portion 62 may be modified to be a flat surface.

The first convex portion 51 and the second concave portion 62 may be excluded, and the second convex portion 52 and the first concave portion 61 may be smoothly continuous with each other so that a corner is not formed therebetween.

The forming method and the forming apparatus of the aforementioned embodiment can also be used to process a metal sheet 21 to form other than the fuel cell separator.

The above embodiments are intended to be illustrative, and the present invention is not limited to the above-described embodiments. Various alternatives, modifications and variations are possible to the disclosed exemplary embodiments without departing from the spirit and scope of the present invention. For example, the subject matter of the present invention may exist in fewer features than all of the features of the particular embodiments disclosed. The claims are incorporated into the detailed description and each claim by itself claims a separate embodiment. The scope of the invention is intended to embrace all such alternatives, modifications and variations, along with all equivalents thereof, within the scope of the claims.

What is claimed is:

1. A method for forming a metal sheet with an apparatus, the method comprising:

providing the apparatus, the apparatus comprising:

a pair of forming dies that are disposed so as to face each other and so as to be movable toward and away from each other, wherein each forming die has a forming surface including:

recessed portions and projecting portions that are alternately continuous with each other; and inclined portions between adjacent ones of the recessed portions and the projecting portions, wherein each of the projecting portions has two convex portions, each of which is disposed closer to one of the inclined portions on each side of each of the projecting portions than a top of each of the projecting portions, and the two convex portions protrude toward one of the recessed portions of an opposite forming die of the pair of forming dies, and a boundary part between each of the two convex portions and each of the inclined portions adjoining each of the two convex portions, wherein each of the two convex portions includes:

a first convex portion including a first curved surface having a first curvature radius; and a second convex portion including a second curved surface having a second curvature radius, the first convex portion of each of the two convex portions is disposed closer to the top of each of the projecting portions than the second convex portion of each of the two convex portions, the second curvature radius of each of the second curved surfaces is smaller than the first curvature radius of each of the first curved surfaces, the boundary part includes:

the second curved surface; and a third curved surface having a third curvature radius, wherein the second curved surface of each of the second convex portions is disposed closer to the first convex portion of each of the two convex portions than the third curved surface of the boundary part of each of the two convex portions, the third curved surface of the boundary part of each of the two convex portions is disposed closer to each of the inclined portions on each side of each of the projecting portions than the second curved surface of each of the second convex portions, and the second curvature radius of each of the second curved surfaces is smaller than the third curvature radius of each of the third curved surfaces of the boundary part; and forming, by moving toward and away from each other the recessed portions and the projecting portions of the pair of forming dies, the metal sheet to have curved portions that are alternately continuous in a corrugated pattern and angled sidewall portions between top parts of adjoining curved portions, wherein the forming comprises:

bending the metal sheet by pressing the first curved surface, the second curved surface and the third curved surface of each of the projecting portions into a position of the metal sheet corresponding to a metal sheet boundary part between the top parts and the sidewall portions of the metal sheet; and thereafter forming the sidewall portions by compression of the pair of forming dies facing and moving towards each other.

2. The method according to claim 1, wherein the forming further comprises forming an outer surface of the top parts of the metal sheet flatly.

3. The method according to claim 1, wherein the forming further comprises forming a part of the metal sheet that has a smaller curvature radius and a part that has a larger curvature radius at the metal sheet boundary part, and wherein the smaller curvature radius is smaller than the larger curvature radius, and the part having the smaller curvature radius is formed closer to the top parts of the metal sheet, and the part having the larger curvature radius is formed closer to the sidewall portions of the metal sheet.

4. The method according to claim 1, wherein parts of the metal sheet positioned on both sides of the curved portions are not pressed by the pair of forming dies when the metal sheet boundary part is bent.

5. An apparatus for forming a metal sheet, the apparatus comprising a pair of forming dies that are disposed so as to face each other and so as to be movable close to or away from each other, wherein each forming die has a forming surface including:

recessed portions and projecting portions that are alternately continuous with each other; and inclined portions between adjacent ones of the recessed portions and the projecting portions, wherein each of the projecting portions has two convex portions, each of which is disposed closer to one of the inclined portions on each side of each of the projecting portions than a top of each of the projecting portions, and the two convex portions protrude toward one of the recessed portions of an opposite forming die of the pair of forming dies, and a boundary part between each of the two convex portions and each of the inclined portions adjoining each of the two convex portions, wherein each of the two convex portions includes:

a first convex portion including a first curved surface having a first curvature radius; and a second convex portion including a second curved surface having a second curvature radius, the first convex portion of each of the two convex portions is disposed closer to the top of each of the projecting portions than the second convex portion of each of the two convex portions, the second curvature radius of each of the second curved surfaces is smaller than the first curvature radius of each of the first curved surfaces, the boundary part includes:

the second curved surface; and a third curved surface having a third curvature radius, wherein the second curved surface of each of the second convex portions is disposed closer to the first convex portion of each of the two convex portions than the third curved surface of the boundary part of each of the two convex portions, the third curved surface of the boundary part of each of the two convex portions is disposed closer to each of the inclined portions on each side of each of the projecting portions than the second curved surface of each of the second convex portions, and the second curvature radius of each of the second curved surfaces is smaller than the third curvature radius of each of the third curved surfaces of the boundary part.

6. The apparatus according to claim 5, wherein each of the recessed portions has a flat bottom surface.

7. The apparatus according to claim 5, wherein a boundary part between a bottom surface of each of the recessed portions and each of the inclined portions has a curved surface.

8. The apparatus according to claim 5, wherein the third curvature radius is larger than the first curvature radius.

9. The apparatus according to claim 5, wherein a concave portion extends in a continuous manner between each of the first convex portions and each of the second convex portions of each of the two convex portions.

10. The apparatus according to claim 5, wherein concave portions each having a curved surface are disposed on both sides of each of the two convex portions.

11. The apparatus according to claim 10, wherein each of the concave portions has a curvature radius larger than the first curvature radius and the second curvature radius of each of the two convex portions.

* * * * *